United States Patent [19]

Kwan

[11] Patent Number: 4,585,423

[45] Date of Patent: Apr. 29, 1986

[54] TOY VEHICLE

[75] Inventor: Cheng L. Kwan, Kowloon, Hong Kong

[73] Assignee: Hang Tjuk Industrial Co. Ltd., Kowloon, Hong Kong

[21] Appl. No.: 599,745

[22] Filed: Apr. 11, 1984

[30] Foreign Application Priority Data

May 4, 1983 [GB] United Kingdom ..... 8312145

[51] Int. Cl.[4] ..... A63H 27/00

[52] U.S. Cl. ..... 446/230; 446/437; 446/460

[58] Field of Search ..... 446/230, 231, 232, 457, 446/462, 440, 437, 460, 431, 463, 465, 466, 469, 287, 289, 290, 291

[56] References Cited

U.S. PATENT DOCUMENTS

| | | | |
|---|---|---|---|
| 1,183,199 | 5/1916 | Hoffmann | 446/440 |
| 1,705,209 | 3/1929 | Ryan | 446/230 X |
| 4,221,077 | 9/1980 | von Winckelmann | 446/460 X |

FOREIGN PATENT DOCUMENTS

| | | |
|---|---|---|
| 472946 | 10/1937 | United Kingdom . |
| 692220 | 6/1953 | United Kingdom . |
| 763807 | 12/1956 | United Kingdom . |
| 1037910 | 8/1966 | United Kingdom . |
| 2106402 | 4/1983 | United Kingdom . |

*Primary Examiner*—Mickey Yu

*Attorney, Agent, or Firm*—Spencer & Frank

[57] ABSTRACT

A toy aeroplane composed of a fuselage, a gear box fixed to the fuselage, a wheel axle holder rotatably mounted in the gear box, a wheel axle which extends rotatably through the gear box and the wheel axle holder and which carries a wheel at each end thereof, a further wheel which is rotatably mounted to the fuselage in front of the gear box, an electric motor mounted in the gear box, a reduction gear mounted in the gear box for transmitting rotation of the electric motor to the wheel axle and to the wheel axle holder and a crank mounted in the gear box for periodically changing the direction of rotation of the wheel axle holder. The axis of rotation of the wheel axle holder is perpendicular to the wheel axle and extends downwardly from the rear to the front of the toy aeroplane, whereby in use, the toy aeroplane turns and tilts alternately to the left and to the right.

5 Claims, 8 Drawing Figures

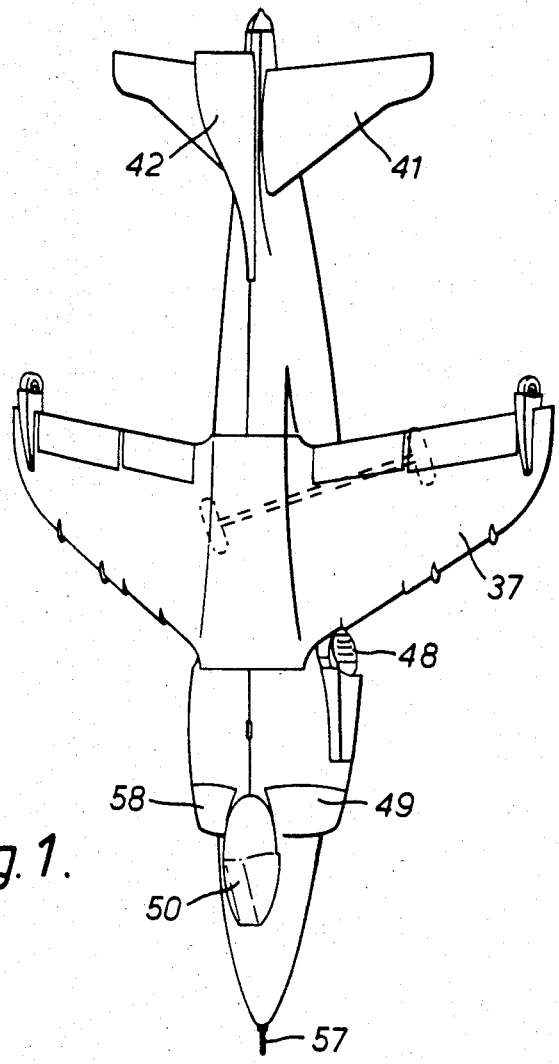
Fig. 1.
Fig. 4.
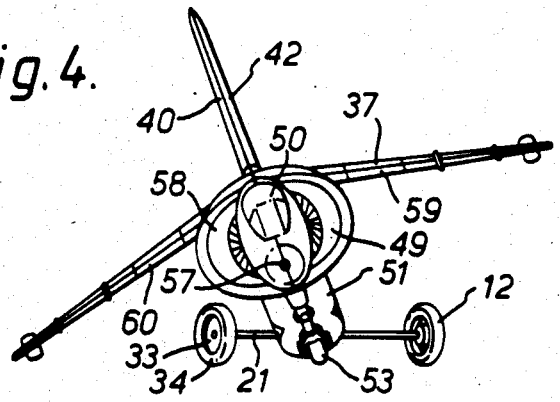

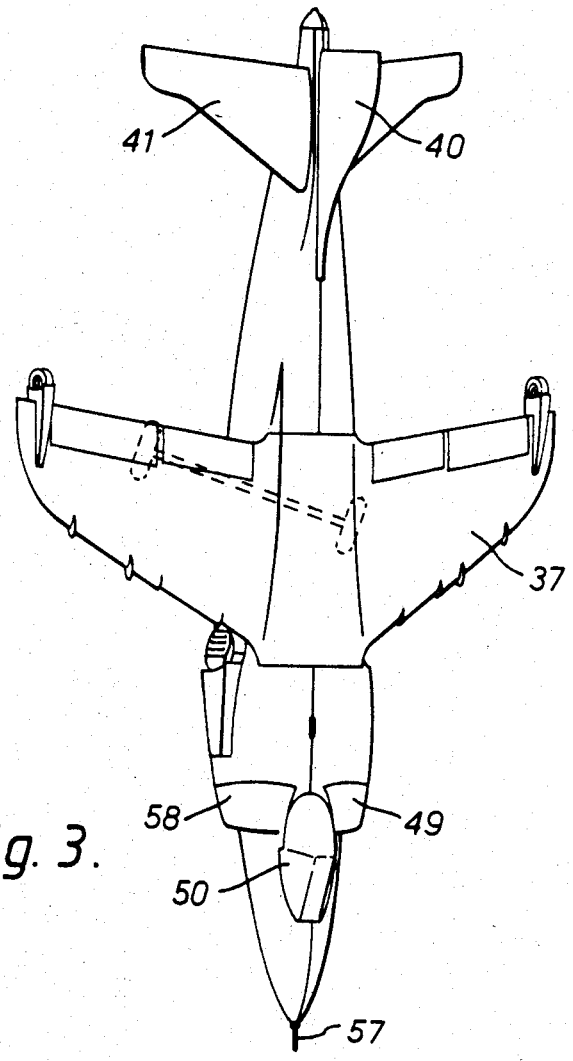
Fig. 3.
Fig. 6.
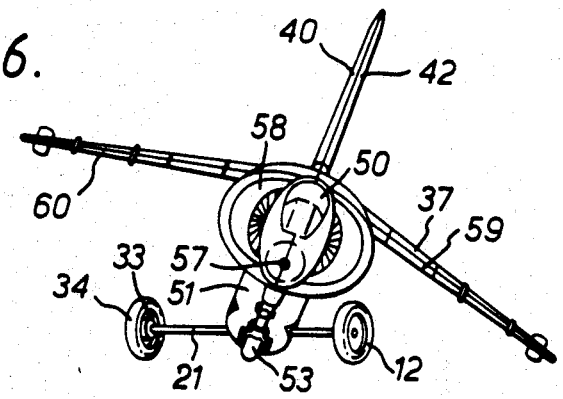

TOY VEHICLE

BACKGROUND OF THE INVENTION

This invention relates to improvements in or relating to toy vehicles, such as toy aeroplanes.

SUMMARY OF THE INVENTION

According to the present invention there is provided a toy vehicle which comprises:

(a) a body, (b) means for contacting a surface, said contacting means defining a first plane which, in use of the toy vehicle on a planar surface, contains said planar surface, and (c) a wheel axle which extends rotatably through said body and is pivotally movable with respect to said body in a second plane which intersects, but is not perpendicular to, said first plane, whereby, in use of the toy vehicle on a planar surface, the toy vehicle turns and tilts alternately to the left and to the right.

Preferably, the toy vehicle comprises a toy aeroplane.

BRIEF DESCRIPTION OF THE DRAWINGS

FIGS. 1 to 3 inclusive are plan views of a toy aeroplane in accordance with an embodiment of the invention, showing the body of the toy aeroplane in respective different orientations relative to the wheel axle of the toy aeroplane, FIGS. 4 to 6 inclusive are front views corresponding to FIGS. 1, 2 and 3, respectively.

DESCRIPTION OF PREFERRED EMBODIMENT

Figure 2:
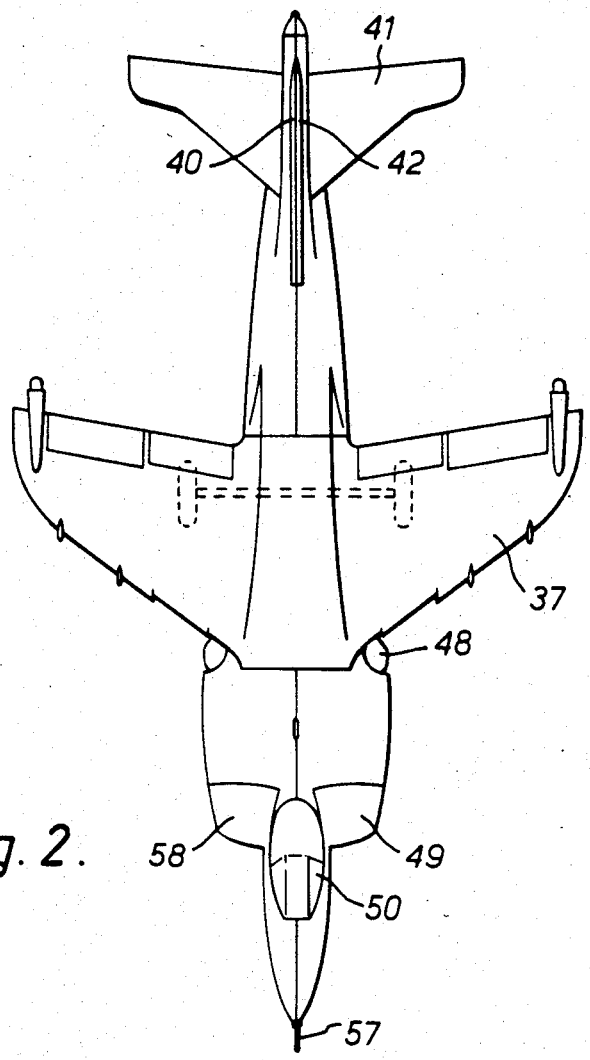
Figure 5:
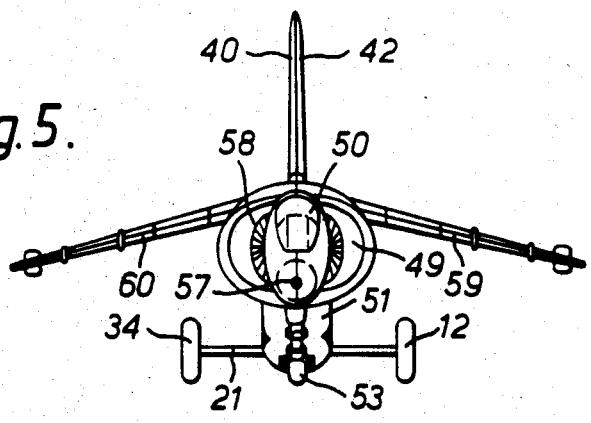
Figure 7:
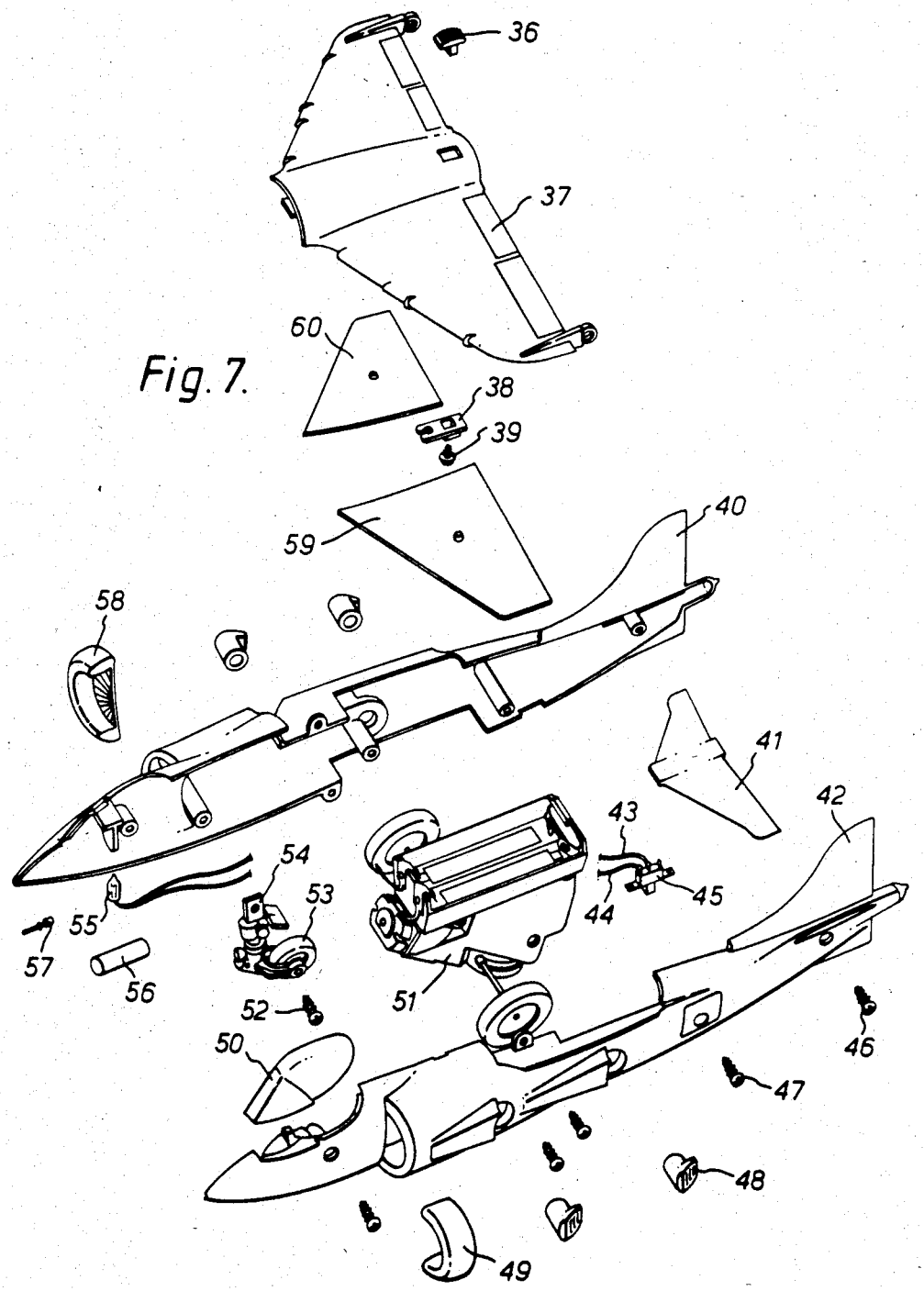
FIG. 7 is a exploded perspective view of the toy aeroplane of FIGS. 1 to 6.

Referring now to the drawings and, in particular, to FIG. 7, a toy aeroplane comprises a main structural body or fuselage which is formed in two halves, a left half 42 and a right half 40. An elevator 41 extends through respective slots formed in the left and right halves of the fuselage and a cockpit 50 and an antenna 57 are secured in position by engagement between the left and right halves of the fuselage. The antenna 57 comprises flexible resilient polyvinylchloride (PVC). A wheel supporter 54 is provided with a planar projection which extends between the left and right halves of the fuselage in the assembled toy aeroplane and through which a metal screw 52 extends to secure the wheel supporter 54 to the right half 40 of the fuselage. A nose landing wheel 53 is rotatably mounted on the wheel supporter 54. A cylindrical iron balancing weight 56 is disposed inside the nose of the toy aeroplane and a light bulb 55 is disposed inside the cockpit 50. A single pole double throw switch 45 is secured underneath a tail portion of the toy aeroplane by engagement between the left and right halves of the fuselage, and each of the light bulb 55 and the switch 45 is provided with two wires 43, 44 for connecting the same to a source of electricity as will be described in detail hereinafter. The toy aeroplane further comprises four jet propellers 48, a left propeller cover 49 and a right propeller cover 58, which are adhered or otherwise rigidly secured to the fuselage. The fuselage 40, 42, the elevator 41, the jet propellers 48, the propeller covers 49, 58, the cockpit 50, the nose landing wheel 53 and the wheel supporter 54 are all made of rigid moulded polystyrene, the cockpit being translucent and the jet propellers 48 and the propeller covers 49, 58 being reflective.

A gear box 51 is disposed within the fuselage and extends downwardly therefrom to define an undercarriage of the toy aeroplane. A wheel axle extends through the gear box 51 and is drivable in rotation on operation of the switch 45 to propel the toy aeroplane, as will be described in detail hereinafter. Also, an upper portion of the gear box 51 is adapted to receive two batteries, as will be described hereinafter.

So that the toy aeroplane may be assembled, there is provided a plurality of metal screws. One screw (not shown) passes through a front portion of the gear box 51 and secures the same to the right half 40 of the fuselage. Another screw 47 passes through the left half 42 of the fuselage and through a projection formed at the rear of the gear box 51 to secure both to the right half 40 of the fuselage. A screw 46 is provided at a tail portion of the toy aeroplane to join the two halves of the fuselage together and three further screws are also provided at front and intermediate portions of the toy aeroplane for the same purpose.

In the assembled toy aeroplane, the two halves of the fuselage define in an upper portion thereof an aperture through which two batteries may be inserted. This aperture is normally covered by wings 37 of the toy aeroplane. The wings 37 comprise rigid moulded polystyrene and are provided thereunder with left and right panels 59, 60 which are adhered or otherwise rigidly secured to the upper portion of the wings 37. The wings 37 define an aperture therein through which extends a latching mechanism comprising a button 36 and a clip 38, both of which are made of rigid moulded polystyrene, and a metal screw 39 which secures the clip 38 to the button 36. The latching mechanism can be moved using the button 36 to a "closed" postion in which a rear portion of the clip 38 engages in a slot formed in a rear edge of the aperture defined in the upper portion of the fuselage. Also, a projection formed on the front edge of the wings 37 engages in a slot formed in the fuselage in front of the aperture. In order to insert batteries into the toy aeroplane, the latching mechanism is moved to an "open" position and the wings 37 are slid rearwardly to remove the same from the aperture.

Figure 8:
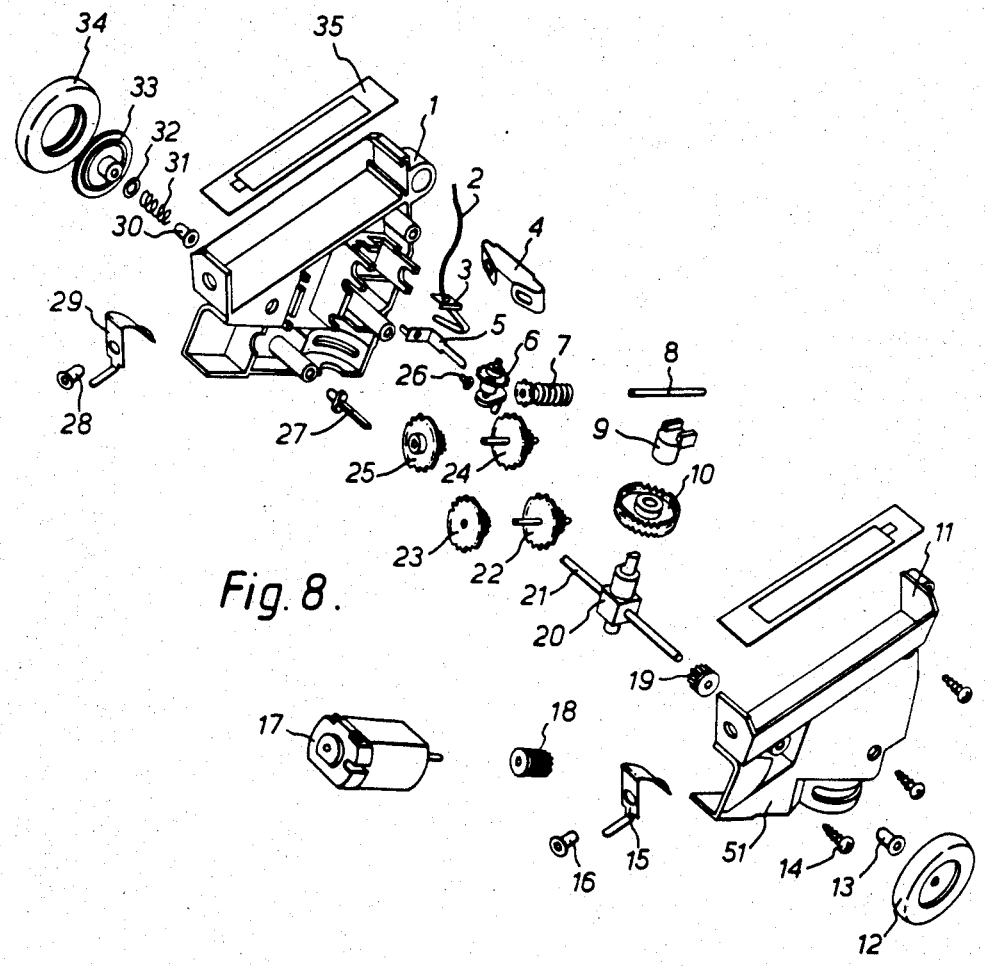
FIG. 8 is an exploded perspective view of a gear box of the toy aeroplane of FIGS. 1 to 7.

Referring now to FIG. 8, the gear box 51 comprises a casing which is formed in two halves, a left half 11 and a right half 1. A lightweight metal wheel axle 21 extends rotatably through the gear box casing and carries a left wheel 12 and a right wheel 33. The left wheel 12 is rigidly mounted to one end of the wheel axle 21 by means of a metal rivet or eyelet 13 which passes through the left wheel 12 and frictionally engages round the wheel axle 21. The right wheel 33 is rigidly mounted to the other end of the wheel axle 21 by means of a metal rivet or eyelet 30 which passes through the right wheel 33 and frictionally engages round the wheel axle 21, a metal washer 32 through which the eyelet 30 passes and which abuts the inner face of the right wheel 33 and a metal compression spring 31 surrounding the eyelet 30 and disposed between the washer 32 and a flanged end portion of the eyelet 30, so that the right wheel 33 is biased towards the respective end of the wheel axle 21. The gear box casing 1, 11 and right wheel 33 comprise a rigid, moulded acrilonitrile/butadiene/styrene copolymer (ABS) and the right wheel 33 is provided with a flexible resilient PVC tyre 34. The left wheel 12 comprises rigid moulded polystyrene.

An upper portion of the gear box casing 1, 11 defines a battery housing containing indicators 35 which may, for example, comprise paper labels adhered to the gear box casing. A resilient copper series contact 4 is disposed in the battery housing at one end thereof and is secured in position by means of parallel slots defined in the right half 1 of the gear box casing, which slots engage opposed edge portions of the contact 4. A copper positive contact 29 is secured to the battery housing at the other end thereof by means of a metal eyelet or rivet 28 which passes through the positive contact 29 and through a hole formed in the right half 1 of the gear box casing, so that part of the positive contact 29 extends outside the gear box casing 1, 11 and part of the positive contact 29 extends resiliently into the battery housing. A copper negative contact 15 is secured to the battery housing adjacent the positive contact 29 by means of a metal eyelet or rivet 16 which passes through the negative contact 15 and through a hole formed in the left half 11 of the gear box casing, so that part of the negative contact 15 extends outside the gear box casing 1, 11 and part of the negative contact 15 extends resiliently into the battery housing. Thus, two batteries may be inserted into the battery housing as hereinbefore described and are then resiliently held in place by the contacts 4, 29, 15.

An electric DC motor 17 is supported by walls of the gear box casing 1, 11 and is connected in series with the batteries in the battery housing and the switch 45 by means of the positive and negative contacts 29, 15 and the two wires 43, 44 with which the switch 45 is provided. The light bulb 55 and a means for making the light bulb 55 flash are also connected in series with the batteries and the switch 45, as will be described in detail hereinafter.

In use, rotation of the drive shaft of the motor 17 is transmitted to the wheel axle 21 by means of a gear chain comprising a pinion 18, which is fixed on the drive shaft for rotation therewith, first, second, third and fourth gears 23, 25, 22 and 24, which are journalled in the gear box casing 1, 11, a crown gear 10 and a pinion 19 which is fixed on the wheel axle 21 for rotation therewith. The crown gear 10 comprises coaxial and integrally formed driving and driven wheels and is rotatably mounted on a mid portion of a wheel axle holder 20, which is journalled in the gear box casing 1, 11 and through which the wheel axle 21 rotatably and slidably extends. Each of the first, second, third and fourth gears 23, 25,22 and 24 comprises a driving wheel and a driven wheel coaxially and integrally formed therewith. The motor pinion 18 meshes with the driving wheel of the first gear 23, the driven wheel of the first gear 23 meshes with the driving wheel of the second gear 25, the driven wheel of the second gear 25 meshes with the driving wheel of the third gear 22, and the driven wheel of the third gear 22 meshes with the driving wheel of the crown gear 10 and the driven wheel of the crown gear 10 meshes with the wheel axle pinion 19. The motor pinion 18, the gears 22, 23, 24 and 25, the crown gear 10, the wheel axle pinion 19 and the wheel axle holder 20 all comprise a tough abrasion resistant material. For example, the crown gear 10 and the wheel axle holder 20 comprise a rigid moulded acetal resin. A resilient flexible member 27, also comprising a moulded acetal resin, is secured to the interior of the gear box casing 1, 11 so as to be vibrated by contact with the rotating motor pinion 18. This produces a sound which simulates that of a jet aeroplane in flight.

In addition to the means described above for effecting rotation of the wheel axle 21 and thus propelling the toy aeroplane, there is provided a means for effecting limited rotation of the wheel axle holder 20 within the gear box casing, comprising the fourth gear 24, a worm gear 7 which is provided at one end with an integral driving wheel therefor, a lightweight conducting metal gear axle 8 which extends through and is fixed to the worm gear 7, the worm gear 7 and the gear axle 8 being journalled in the gear box casing 1, 11, a crank 6, which is also journalled in the gear box casing 1, 11 and which is provided with an integral driving wheel, and a guide member 9 which is secured to an end portion of the wheel axle holder 20 by means of cooperating portions of noncircular cross-section provided on the guide member 9 and the wheel axle holder 20 respectively. In use, the driven wheel of the third gear 22 meshes with the driving wheel of the fourth gear 24, the driven wheel of the fourth gear 24 meshes with the driving wheel of the worm gear 7, the worm of the worm gear 7 meshes with the driving wheel of the crank 6, the crank 6 engages the guide member 9 and the guide member 9 effects limited rotation of the wheel axle holder 20 in alternating directions. Slots are provided in the gear box casing 1, 11 to accommodate the associated turning of the wheel axle 21. The crank 6, the worm gear 7 and the guide member 9 comprise a tough moulded acetal resin.

As can more clearly be seen in FIGS. 1 to 6 inclusive, when the switch 45 is closed and the toy aeroplane is placed on a smooth surface, the toy aeroplane is not only propelled along but also effects turning and tilting movements. Because the wheel axle 21 repeatedly turns in the clockwise and anticlockwise directions, the toy aeroplane repeatedly turns to the left and to the right. In addition, because the plane in which the wheel axle 21 moves is inclined with respect to the aeroplane body, and in particular with respect to the plane containing the wings 37, the aeroplane body repeatedly tilts to the left and to the right. Thus, the toy aeroplane can simulate the movement of a jet aeroplane in flight.

Referring again to FIG. 8, a means for making the light bulb 55 flash comprises a first resilient copper contact 5, which is secured within the gear box casing 1, 11 by means of a metal eyelet or rivet 26 which passes through the contact 5 and through a hole in the gear box casing 1, 11, and a second resilient copper contact 3, which is seated in a slot formed in an inner wall of the gear box casing 1, 11. The first contact 5 is connected to the light bulb 55 by one of the wires 43, 44 with which the light bulb 55 is provided. The second contact 3 is connected by a wire 2 to the positive contact 29 of the battery housing. In addition, the other of the wires 43, 44 with which the light bulb 55 is provided and one of the wires 43, 44 with which the switch 45 is provided are both connected to a first contact of the motor 17, the other of the wires 43, 44 with which the switch 45 is provided is connected to the negative contact 15 of the battery housing and a second contact of the motor 17 is connected to the positive contact 29 of the battery housing.

The first contact 5 of the means for making the light bulb 55 flash resiliently contacts one end of the gear axle 8 and the second contact 3 resiliently contacts the gear axle 8 adjacent the other end thereof. During rotation of the gear axle 8, contact between the second contact 3 and the gear axle 8, is periodically broken, because an extension of the worm gear 7, which comprises an insulating material, passes between the second contact 3 and the gear axle 8. Thus, the light bulb 55 flashes on and off once during each revolution of the gear axle 8.

In order that the gear box 51 may be assembled, three metal screws 14 are provided which pass through holes formed in the left half 11 of the gear box casing and engage in internally threaded projections formed on the inner face of the right half 1 of the gear box casing.

Thus, the toy aeroplane described and illustrated can imitate the movements of a jet aeroplane baking and turning alternately to the left and to the right and is provided with a flashing light in the cockpit. Means are also provided for making a noise imitating that of a jet engine.

Although a particular embodiment of the Invention has been described and illustrated herein, it is recognised that modifications may readily occur to those skilled in the art and consequently it is intended that the following claims be interpreted to cover such modifications and equivalents.

What is claimed is:

1. A toy vehicle, which comprises:

(a) a body, (b) means for contacting a surface, said contacting means defining a first plane which, in use of the toy vehicle on a planar surface, contains said planar surface, (c) a wheel axle which extends rotatably through said body and is pivotally movable with respect to said body in a second plane which intersects, but is not perpendicular to, said first plane, (d) an electric motor having a drive shaft, (e) means for transmitting rotation of said electric motor to said body and to said wheel axle, said transmitting means comprising:

a first pinion fixed for rotation with said drive shaft;

a rotatably mounted crown gear having a driven and a driving wheel;

a second pinion fixed for rotation with said wheel axle; and first, second and third gears each having a respective driven wheel and a respective driving wheel, said first pinion meshing with said first gear driving wheel, said first and second gear driven wheels meshing with said second and third gear driving wheels, respectively, and said third gear driven wheel meshing with said crown gear driving wheel, said crown gear driven wheel meshing with said wheel axle pinion for rotating said wheel axle, and (f) means for periodically changing the direction of rotation of said body with respect to said wheel axle, said direction changing means comprising:

a worm gear having first and second ends and having a driving wheel fixed thereto at said first end;

a fourth gear having a driven and a driving wheel, said third gear driven wheel meshing with said fourth gear driving wheel and said fourth gear driven wheel meshing with said worm gear driving wheel;

a crank having a driving wheel, said crank driving wheel meshing with said worm gear; and a guide member engaging said crank and being secured with respect to said wheel axle for effecting limited rotation of said wheel axle holder in alternating directions, whereby, in use of the toy vehicle on a planar surface, pivotal movement of said body with respect to said wheel axle and rotation of said wheel axle is effected so that the toy vehicle turns and tilts alternately to the left and to the right.

2. The toy vehicle of claim 1, which is a toy aeroplane.

3. The toy vehicle of claim 1, wherein said contacting means comprises support means, the support means comprising first and second wheels which are fixed to said wheel axle, and further support means.

4. The toy vehicle of claim 3, wherein said further support means comprises a wheel which is rotatable with respect to said body but is not fixed to said wheel axle.

5. A toy aeroplane, which comprises:

(a) a fuselage having an underside, a front end and a rear end, (b) a gear box which is fixed to said underside of said fuselage, (c) a wheel axle holder which is rotatably mounted in said gear box and has an axis of rotation, (d) a wheel axle having an axis and first and second ends which is rotatably held by said wheel axle holder and extends rotatably through said gear box, (e) a first wheel which is fixed to said first end of said wheel axle, (f) a second wheel which is fixed to said second end of said wheel axle, (g) a further wheel which is rotatably mounted on said underside of said fuselage between said front end of said fuselage and said gear box, (h) an electric motor having a drive shaft for rotating said wheel axle about the axis thereof, said electric motor being mounted in said gear box, (i) reduction gear means mounted in said gear box for transmitting rotation from said electric motor to said wheel axle, said reduction gear means comprising:

a first pinion gear fixed for rotation with said motor drive shaft;

a crown gear rotatably mounted on said wheel axle holder, said crown gear having a driven and a driving wheel coaxially and integrally formed therewith;

a second pinion fixed for rotation with said wheel axle; and first, second and third gears each having a respective driven and a respective driving wheel coaxially and integrally formed therewith, said first pinion meshing with said first gear driving wheel, said first and second gear driven wheels meshing with said second and third gear driving wheels, respectively, and said third gear driven wheel meshing with said crown gear driving wheel, said crown gear driven wheel meshing with said wheel axle pinion for rotating said wheel axle, (j) crank means mounted in said gear box for rotating said wheel axle holder about said axis of rotation in alternating directions, said crank means comprising:

a worm gear having first and second ends and having a driving wheel fixed thereto at said first end;

a gear axle extending through and fixed to said worm gear;

a fourth gear having a driven and a driving wheel coaxially and integrally formed therewith, said third gear driven wheel meshing with said fourth gear driving wheel and said fourth gear driven wheel meshing with said worm gear driving wheel;

a crank having a driving wheel, said crank driving wheel meshing with said worm gear; and a guide member engaging said crank, said guide member and said wheel axle holder having cooperating portions of non-circular cross section securing the guide member to said wheel axle holder for thereby effecting limited rotation of said wheel axle holder in alternating directions, wherein said axis of rotation of said wheel axle holder is perpendicular to said wheel axle and extends downwardly from said rear end to said front end of said fuselage, whereby, in use, the toy aeroplane turns and tilts alternately to the right and to the left.

* * * * *

UNITED STATES PATENT AND TRADEMARK OFFICE

CERTIFICATE OF CORRECTION

PATENT NO. : 4,585,423

DATED : April 29, 1986

INVENTOR(S) : Lap Kwan CHENG

It is certified that error appears in the above-identified patent and that said Letters Patent is hereby corrected as shown below: On the title page:

In the heading of the patent, under [75], the inventor's name should read --Lap Kwan Cheng--.

Signed and Sealed this

*Twenty-ninth* Day of *July 1986*

[SEAL]

*Attest:*

DONALD J. QUIGG

*Attesting Officer*

*Commissioner of Patents and Trademarks*